US010386091B2

(12) United States Patent
Carter

(10) Patent No.: US 10,386,091 B2
(45) Date of Patent: Aug. 20, 2019

(54) WATER EVAPORATIVE COOLED REFRIGERANT CONDENSING RADIATOR UPGRADE

(71) Applicant: Robert S. Carter, Fergus (CA)

(72) Inventor: Robert S. Carter, Fergus (CA)

( * ) Notice: Subject to any disclaimer, the term of this patent is extended or adjusted under 35 U.S.C. 154(b) by 0 days.

(21) Appl. No.: 15/360,351

(22) Filed: Nov. 23, 2016

(65) Prior Publication Data

US 2017/0219245 A1 Aug. 3, 2017

Related U.S. Application Data

(60) Provisional application No. 62/288,586, filed on Jan. 29, 2016.

(51) Int. Cl.
*F24F 13/22* (2006.01)
*F25D 16/00* (2006.01)
(Continued)

(52) U.S. Cl.
CPC ..... *F24F 13/222* (2013.01); *F24F 13/24* (2013.01); *F25B 25/00* (2013.01); *F25D 16/00* (2013.01);
(Continued)

(58) Field of Classification Search
CPC ..... F24F 13/222; F24F 13/24; F25D 16/00; F25B 25/00
(Continued)

(56) References Cited

U.S. PATENT DOCUMENTS 4,443,387 A 4/1984 Gordon
4,479,366 A 10/1984 Lanier et al.
(Continued)

FOREIGN PATENT DOCUMENTS

WO WO 2013104343 7/2013

OTHER PUBLICATIONS

Mistcooling, Inc, AC Precooling Mister System Kit Demo, Jul. 10, 2013 https://www.youtube.com/watch?v=yVaCu6p9HIg.*

*Primary Examiner* — Keith M Raymond
*Assistant Examiner* — Nael N Babaa
(74) *Attorney, Agent, or Firm* — Berggren LLP

(57) ABSTRACT

A direct evaporative cooling system add-on to the existing air conditioning system for more effectively removing the Latent-heat-of-condensation of the refrigerant of the system greatly enhances the EER rating of the system. Upgrading the conventional air-conditioning systems from air cooled refrigerant-condensing-radiator to water-evaporative-cooling via an ADD-ON unit, comprising a reservoir that stores water to be periodically pumped up a pipe under pressure controlled by the electronic controller for timing and quantity. The water is sprinkling uniformly with the help of a plurality of holes in the pipeline wetting the condensing radiator, some of which evaporates cooling the radiator and the excess returning to the reservoir to be recycled over the radiator repeatedly allowing the evaporation and heat exchange process to continue. This cooling effect reduces the pressures required by the compressor at the same time reducing the power drawn from the electrical grid saving money on the electric bill and in turn reducing the carbon foot print created by the use of air conditioning.

17 Claims, 3 Drawing Sheets

(51) Int. Cl.

| | |
|---|---|
| ***F25B 25/00*** | (2006.01) |
| ***F24F 13/24*** | (2006.01) |
| *F24F 11/85* | (2018.01) |
| *F24F 140/60* | (2018.01) |
| *F24F 140/30* | (2018.01) |

(52) U.S. Cl.
CPC ..... *F24F 11/85* (2018.01); *F24F 2013/225* (2013.01); *F24F 2013/228* (2013.01); *F24F 2140/30* (2018.01); *F24F 2140/60* (2018.01)

(58) Field of Classification Search
USPC ..... 62/289
See application file for complete search history.

(56) References Cited

U.S. PATENT DOCUMENTS

| | | | | |
|---|---|---|---|---|
| 5,003,789 | A * | 4/1991 | Gaona | F24F 5/0035 261/25 |
| 5,121,610 | A | 6/1992 | Atkinson et al. | |
| 5,377,500 | A | 1/1995 | Yang | |
| 2013/0272840 | A1* | 10/2013 | Fujioka | F04D 27/00 415/1 |
| 2013/0283837 | A1* | 10/2013 | Takahashi | F24F 1/022 62/238.6 |
| 2014/0047841 | A1* | 2/2014 | Yim | F22D 5/26 60/670 |
| 2014/0174710 | A1 | 6/2014 | Guo | |
| 2014/0202658 | A1* | 7/2014 | Yang | H01L 23/4735 165/80.4 |
| 2014/0210114 | A1* | 7/2014 | Staniforth | F04D 25/08 261/30 |

* cited by examiner

WATER EVAPORATIVE COOLED REFRIGERANT CONDENSING RADIATOR UPGRADE

CROSS REFERENCE TO RELATED APPLICATIONS

This application claims the benefit of U.S. Provisional Application No. 62/288,586, filed Jan. 29, 2016, having the same inventive entity herein, titled: "WATER-EVAPORATIVE-COOLED, REFRIGERANT-CONDENSING-RADIATOR."

FEDERALLY SPONSORED RESEARCH AND DEVELOPMENT

Not applicable.

MICROFICHE

Not applicable

BACKGROUND OF THE INVENTION (1) Field of the Invention

The present invention relates to Air Conditioning and Refrigeration systems, in particular the refrigerant-condensing-radiator part of the typical residential or commercial air conditioning system. The invention, particularly relates to the more effective method and direct water-evaporative-cooling the refrigerant-condensing-radiator, reducing the compressor power consumption, enhancing the energy efficiency ratio (EER), reducing the load on the electrical grid in turn reducing carbon emissions.

(2) Background of the Invention

All conventional air-conditioning or refrigerating facilities to remove the latent-heat energy from the refrigerant-condensing-radiator, use a forced-air heat-exchange process. The refrigerant-evaporation process inside the cooled space absorbs heat-energy from the cooled space and the heat-energy being expelled from the refrigerant-condensing-radiator outside the cooled space via the forced-air heat-exchange process is in fact the heat-energy being removed from the cooled space via refrigerant-evaporation process part of the air conditioning system. In common practice heat exchange using a forced-air-cooled condensing-radiator, and sometimes water-cooled heat-exchange process to dispose of the heat energy removed from the refrigerant-condensing-radiator is found in use today. The power consumed by the refrigerant-compressor prior to the refrigerant-condensing-radiator is directly affected by the efficiency of the cooling process used to cool the refrigerant-condensing-radiator. The efficiency of cooling the refrigerant-condensing part of the refrigeration system is what sets the "energy efficiency ratio" (EER) value of the air-conditioner or any type of refrigeration system.

Conventionally, a fan driven by an electric motor is used to draw air through the refrigerant-condensing-radiator to facilitate the refrigerant cooling and condensing process. In fact there are many drawbacks to an air-cooled condensing radiator causing substantial inefficiencies due to the fact that to adequately remove all the latent-heat energy via air-cooling, it would take a very large radiator, motor and fan wasting even more electrical energy. The compressor prior to the condensing-radiator is the largest consumer of electrical energy in the refrigeration system and the amount of electrical energy it uses is directly affected by the efficiency of cooling the refrigerant-condensing-radiator. There are two ways or a combination of both ways to force the condensing of the refrigerant from a gas to a liquid, one is to cool it to below the dew point and the second is to compress it thus raising the dew point allowing it to condense at a higher temperature, the latter being the case currently used in most or all refrigeration systems. The problem with compressing the refrigerant vapor to force condensation rather than to cool it adequately, is that as the pressure rises, the compressor draws proportionately more electrical energy reducing efficiency giving a poorer EER rating. The cooler the refrigerant vapor the lower the pressure required for the compressor to achieve condensation and the less electrical energy used, thus improving the EER rating!

There have been a number of solutions to provide a better cooling mechanism for the radiator module by a means of water-cooled mechanisms without using the forced air mechanism. For example, the following patents are herein incorporated by reference for their supportive teachings on swamp coolers or evaporative coolers:

U.S. Pat. No. 5,377,500 A relates to a water cooled air conditioner which comprises a compressor, an evaporator, a cooling fan, a low pressure pipe, a high pressure pipe, a radiator, a cooling motor, and a condenser. The apparatus is characterized in that the heat exchanging efficiency between the cooling water and the refrigerant is highly enhanced thereby intensifying the cooling effect and increasing the temperature of the cooling water flowing out of the apparatus to an acceptable degree for use as residential hot water. Further, the heated water from the radiator may be sprayed on to the external surface of the radiator to provide evaporative cooling thereof.

WO 2013104343 A1 describes a water-cooling radiator for electronic devices, in particular a water-cooling radiator for dissipating heat produced by computer devices, such as servers, network devices, and PCs. Disposed inside of a protective shell are a water-cooling board, a water storage chamber, a water pump, water pipes, a radiating water tank, water-absorbing sponges, fans, and a temperature-controlling rotation-speed adjuster. Spaces between different components are filled with water-absorbing sponges, and the sponges can absorb the cooling water leaked out of the water-cooling radiator in a timely manner. The temperature-controlling rotation-speed adjuster is used for adjusting the rotation speeds of the fans and the water pump. The water-cooling radiator is easy to install and is waterproof to a certain degree.

US 20140174710 A1 describes a water-cooling radiator includes a cooling module, a control circuit, a temperature sensor, and a display. The temperature sensor is used to sense an instant temperature of a heat generating device and output the instant temperature of the control circuit. The control circuit outputs a voltage of the cooling module corresponding to the instant temperature received from the temperature sensor. The control circuit compares the instant temperature with a preset temperature. When the instant temperature is higher than the preset temperature, the control circuit increases the voltage outputted to the cooling module to reduce the instant temperature of the heat generating device. When the instant temperature is lower than the preset temperature, the control circuit reduces the voltage outputted to the cooling module.

U.S. Pat. No. 5,121,610, by Atkinson et. al., issued Jun. 16, 1992, teaches of an air cycle air conditioner for heating and cooling including a compressor, turbine, heat exchanger and high speed electric motor that are thermostatically controlled to supply either hot or cold conditioned air to an air space.

Swamp coolers are well known in arid environments. For example, a swamp cooler will drip water along a material and blow air over it toward the place to be cooled. The evaporating water will cool the air due to the heat absorbed that is used in the evaporative process.

U.S. Pat. No. 4,443,387, by Gordon, issued Apr. 17, 1984, teaches of an evaporative cooling device and process for cooling large areas.

U.S. Pat. No. 4,479,366, by Lanier et al., issued Oct. 30, 1984, teaches of evaporative cooler.

The aforesaid documents and other similar solutions may strive to provide a condensing radiator with a special coil pipe to increase the heat exchanging efficiency, thereby increasing the cooling effect and the temperature of the cooling water flowing out of the apparatus to an acceptable degree; however, they still have a number of limitations and shortcomings such as, but not limited to, a condensing radiator having a plastic pipe with a plurality of small holes for a streamlined water drop which is suitable for applications to air-cooling and water-membrane evaporation type refrigerating and air-conditioning facility, so air force can pass through the entire surface of the pipe wall along the streamline, to increase air flow speed, increasing heat cycle evaporation and radiation. The above mentioned prior arts can only perform certain aspects say for example, provides a system which is absorbing a nominal amount of potential heat during evaporation process, significantly reducing refrigerant temperature with nominal carbon emission, sufficiently developing evaporation type cooling effects.

The aforesaid documents and other similar solutions may strive to provide a condensing radiator with increased heat exchanging efficiency using varied methods air and water cooling of the condensing-radiator, but limited to the high cost of the aforesaid solutions and the simple and basic fact the air-cooling and water-cooling have considerable limitations.

Air-cooling limitations are related to the fact that the refrigerant-condensing-radiator can't be cooled to below the air temperature (ambient air temperature) of the air being used to cool it, therefore when the ambient air temperature rises, the cooling efficiency is reduced.

Water-cooling using a water-refrigerant heat-exchanger, is effective only if there is a very large supply of cold water available to do the cooling (a large lake etc.), and adequate cold water supply is rarely available, also making this solution impractical.

Accordingly, there remains a need in the prior art to have an improved and low cost water-evaporative-cooled condensing-radiator system which provides a controller to monitor the compressor power consumption and control the water flowing to the refrigerant-condensing-radiator in the refrigerant-condensing process efficiently reducing the consumption of power, therefore overcoming the aforesaid problem and shortcomings

SUMMARY OF THE INVENTION

In view of the foregoing limitations inherent in the known types of air-cooled and water-cooled refrigerant-condensing-radiators now presented in the prior art, the present invention provides a superior method of cooling the refrigerant-condensing-radiator using direct-water-evaporative-cooling of the existing refrigerant-condensing-radiator. Most importantly the present invention is intended to be used as a LOW-COST-ADD-ON to existing equipment presently in service. As such, the general purpose of the present invention, which will be described subsequently in greater detail, is to provide a low cost, new and improved method of cooling the refrigerant-condensing-radiator having a controller for controlling the timing and quantity of water delivered to the radiator, which has many advantages that the prior art lacks and none of the disadvantages.

One object of the present invention is to take advantage of the basic physical fact that using the evaporation of water to absorb the latent-heat-energy of the refrigerant-condensation-process (970 BTU per pound of water evaporated) is far more effective as a cooling method than is in common practice or mentioned in the prior art.

It is another object of the present invention while possibly being used in complete new systems for sale is also to provide an ADD-ON-UNIT to convert existing conventional air conditioning equipment currently in service from air-cooled to evaporative-cooled condensing-radiators at relatively low cost to the owner, saving on the electrical bill up to 50%.

It is another object of the present invention and provided by the ADD-ON-UNIT to absorb large amounts of latent-heat-of-condensation by, but not limited to, sprinkled water method, for wetting the existing radiator to facilitate effective evaporative-cooling of said radiator and refrigerant during the condensing process, significantly reducing refrigerant temperature allowing condensing of the refrigerant at lower pressures, reducing the load on the compressor, reducing compressor noise pollution while extending the life of the compressor and enhancing the EER rating.

It is another object of the present invention to provide as part of the conversion to water-evaporative-cooling, to recycle the condensate water from inside the cooled space that condenses on the cold evaporator-radiator back to the reservoir of the add-on as part of the make-up water, eliminating the need to dispose of the condensate as needed with the conventional systems therefore making good use of the condensate.

It is another object of the present invention to provide a reverse-osmosis system to minimize the TDS (Totally dissolved solids) of the makeup water, minimizing any possibility of solid residue to be deposited on the condensing-radiator as a result of the evaporation of water on the radiator.

It is another object of the present invention that there will be adjustments made to the refrigerant charge levels and pressures to maximize the effectiveness for the water-evaporative-cooling of the condensing-radiator.

In this respect, before explaining at least one embodiment of the present invention in detail, it is to be understood that the invention is not limited in its application to the details of construction and to the arrangements of the components set forth in the following description or illustrated in the drawings. The present invention is capable of other embodiments and of being practiced and carried out in various ways. Also, it is to be understood that the phraseology and terminology employed herein are for the purpose of description and should not be regarded as limiting.

These together with other objects of the present invention, along with the various features of novelty which characterize the present invention, are pointed out with particularity in the disclosure. For a better understanding of the invention, its operating advantages and the specific objects attained by its uses, reference should be made to the accompanying drawings and descriptive matter in which there are illustrated preferred embodiments of the present invention.

BRIEF DESCRIPTION OF THE DRAWINGS

The present invention will be better understood and objects other than those set forth above will become apparent when consideration is given to the following detailed description thereof. Such description makes reference to the annexed drawings wherein.

DETAILED DESCRIPTION OF THE INVENTION

In the following detailed description reference is made to the accompanying drawings which form a part hereof, and in which is shown by way of illustration specific embodiments in which the present invention may be practiced. These embodiments are described in sufficient detail to enable those skilled in the art to practice the invention, and it is to be understood that the embodiments may be combined, or that other embodiments may be utilized and that structural and logical changes may be made without departing from the spirit and scope of the present invention. The following detailed description is, therefore, not to be taken in a limiting sense, and the scope of the present invention is defined by the appended claims and their equivalents.

Figure 1:
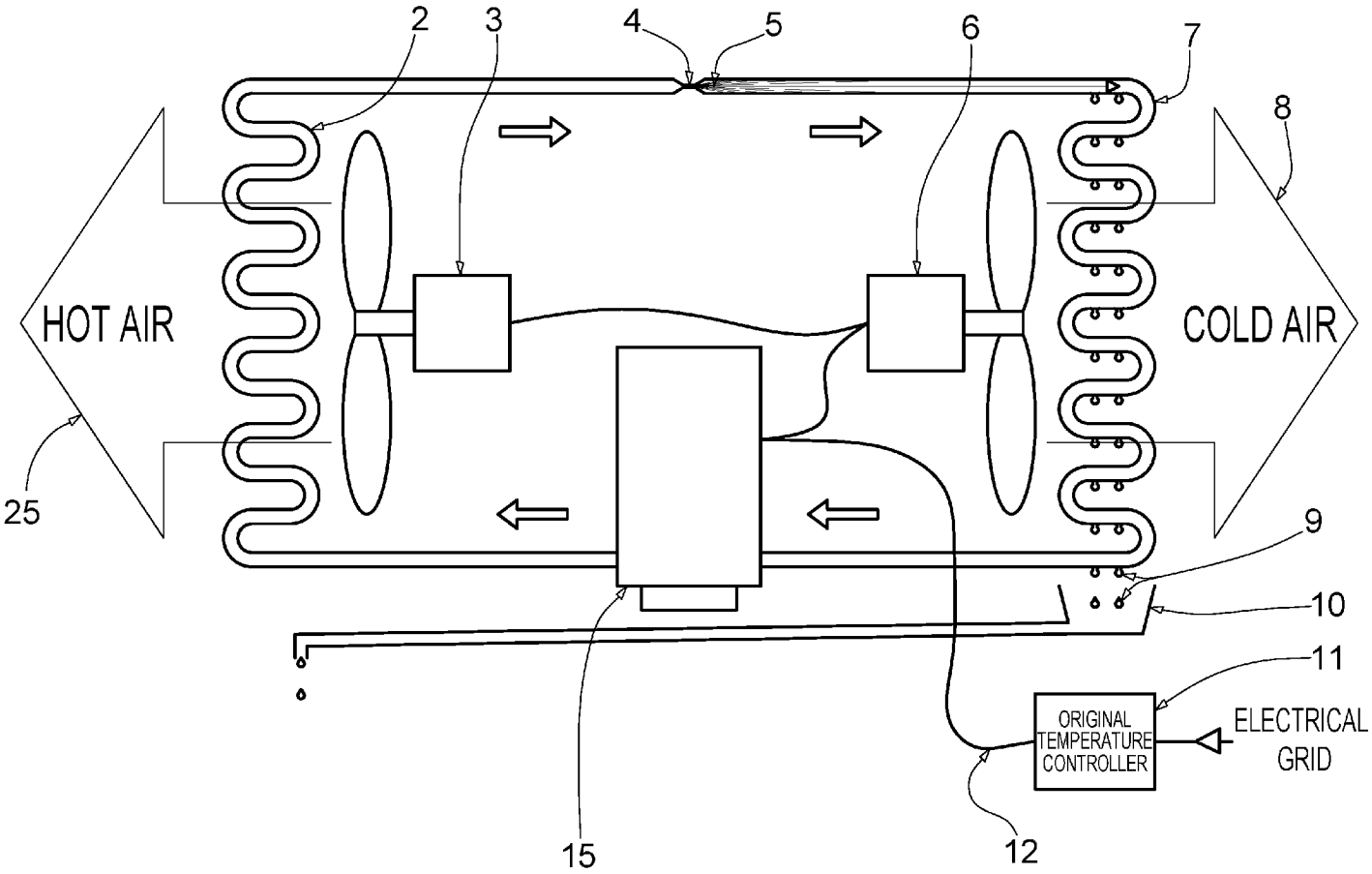
FIG. 1 is a schematic representation of a typical residential air conditioning.

FIG. 1: For the readers to understand the improvements provided by the present invention they must first understand how current air conditioning systems work. Here is a simplified explanation of the current systems that refers to the schematic representation of a typical residential air conditioning system in FIG. 1.

The typical air conditioning system or refrigeration system is comprised of seven basic components: the temperature controller 11, the evaporator radiator 7, the evaporator radiator fan 6, the compressor 15, the condensing radiator 2, the condensing radiator fan 3, and the expansion valve 4.

High pressure liquid refrigerant is expelled through the expansion-valve 4 where the pressure suddenly drops to a lower pressure that is below the dew point of the refrigerant causing the liquid refrigerant to rapidly vaporize 5. This sudden vaporization 5 of the refrigerant requires by the laws of physics that the heat energy (latent heat of vaporization) required to facilitate evaporation is absorbed from the surrounding environment, the evaporator-radiator 7 while the fan 6 forces warm air from the cooled space through the evaporator-radiator 7 providing the necessary energy (latent heat of vaporization) for vaporization to take place by transferring the heat energy from the warm air coming from the cooled space to the evaporator-radiator 7, that is being chilled by the refrigerant-evaporation process cooling that air 8 and returning it to the cooled space. The vaporized refrigerant after leaving the evaporator-radiator 7 is drawn into the compressor 15 that compresses it to a pressure takes the refrigerant above its dew point needed to force condensation of the vaporized-refrigerant back to the liquid form. The condensing process of the refrigerant requires by the laws of physics that the vaporized refrigerant give off the energy (latent heat of condensation) to the surrounding environment, the Condensing-radiator 2, in order to return to the liquid state and the heat energy 25 from the condensing-radiator 2 is dispersed to the outside environment by the fan 3. This now condensed liquid refrigerant under the high pressure created by the compressor 15 passes back through the expansion-valve 4 decompressing returning to a vapor 5 to repeat the cycle.

The water vapor contained in the humid warm air passing over the evaporator-radiator 7 is rapidly cooled 8. This cooling takes the air temperature below the dew point of the water vapor thus causing the water vapor to condense into liquid water 9 on the evaporator-radiator 7 and is collected by catch pan 10 and disposed of, thus the system in removing water from the air in the cooled space lowers the relative humidity of the cooled space at the same to time that it cools the air.

The air being expelled from the condensing-radiator 2 by the fan 3 can exceed temperatures in excess of 50 degrees Centigrade depending on the ambient air temperature of the air supplied to the fan 3. The higher the ambient air temperature supplied to fan 3, the higher the pressure required by the compressor 15 to force condensation of the refrigerant in the condensing-radiator 2. The power consumption of the Compressor 15 is directly proportional to the pressure it needs to force condensation of the refrigerant vapor inside the refrigerant-condensing-radiator 2, therefor the cost to operate the air conditioning system is dependent upon the pressures that the compressor 15 produces. As the reader can see the higher the ambient outside air temperature the poorer the efficiency (EER rating) of the entire system, thus air cooling of the refrigerant-condensing-radiator 2 is grossly inadequate and costly. The compressor 15, fan 3 and fan 6 are all controlled by the temperature controller 11 in the cooled space that maintains the desired temperature by controlling the delivery power to them via electric cables 12 from the electrical grid.

Figure 2:
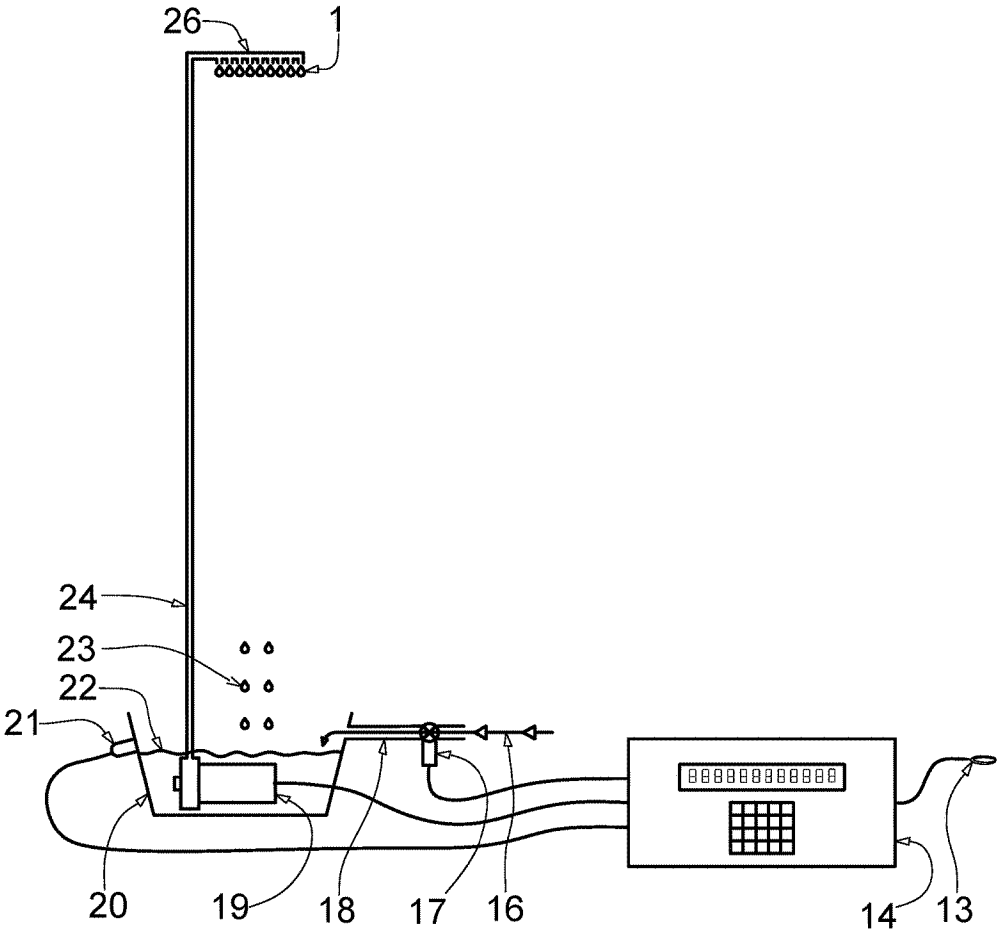
FIG. 2 is a schematic representation illustrating the apparatus.

FIG. 2 schematically illustrates the components contained in the present invention as an ADD-ON to the conventional air conditioning system described in FIG. 1. A detailed description of the entire system combined will be described in detail in FIG. 3. One can see that the original system described in FIG. 1 does not depend on the add-on shown in FIG. 2 for normal operation, but does benefit greatly by the extra cooling effect of the equipment shown in FIG. 2.

The present invention in FIG. 2 illustrates the simple and inexpensive components that can take many forms but at a minimum require a controller 14, a power consumption sensor 13, a reservoir 20, a solenoid valve 17, a pump 19, a water level sensor 21, a water delivery pipe 24 a pipe with a series of holes 26 for wetting the condensing-radiator 2 shown in FIG. 1, and a purified water supply 16 which all are responsible for the timely and orderly delivery of water 1 that will run down through the condensing-radiator 2 FIG. 1 wetting it allowing evaporation of some of the water with the remaining water 23 returning to the reservoir 20 for recycling. All of these components in FIG. 2 are readily available and of low cost.

Figure 3:
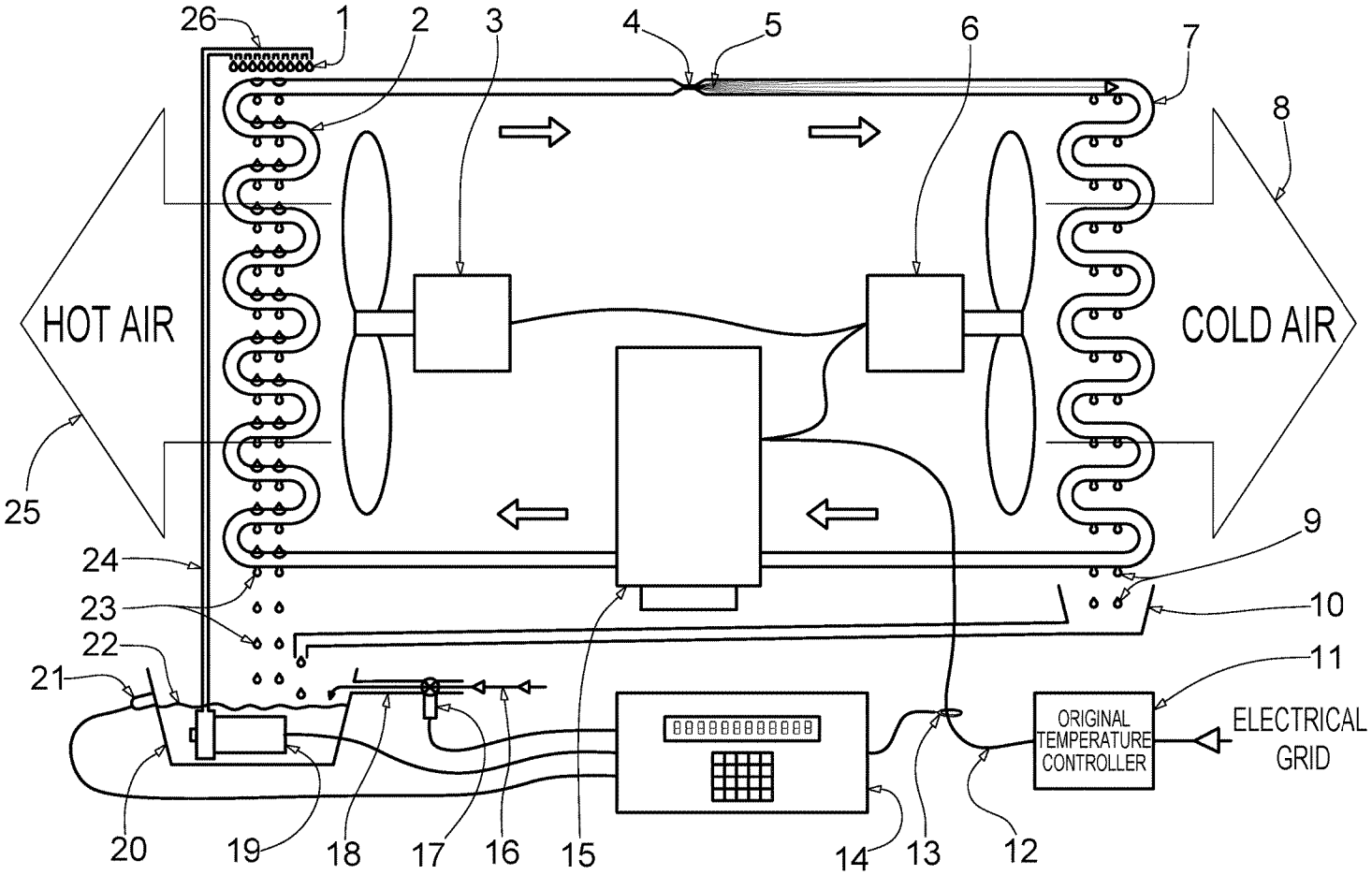
FIG. 3 is another schematic representation that includes the typical residential air conditioning system illustrated in FIG. 1 combined with the schematic representation of the apparatus included in the ADD-ON unit illustrated in FIG. 2 that facilities the water-evaporative-cooling of the existing condensing-radiator.

FIG. 3 a schematic representation of the entire combined system will focus on the detail operation of the present invention shown in FIG. 2 added as an ADD-ON to the original air conditioning system described in FIG. 1.

As illustrated in FIG. 1 and described in the subsequent paragraphs, the efficiency rating (EER) of the overall air conditioning system is dependent upon the pressure require by the compressor 15 to force the condensation of the refrigerant with only the outside hot ambient air 25 to cool the condensing-radiator 2 while being forced though the condensing-radiator 2 by the fan 3 and the air 25 can exceed temperatures of 50 degrees Centigrade.

The present invention provides a reservoir 20 that is supplied with purified water 16 via makeup water pipe 18 and solenoid 17 that is controlled by controller 14 to maintain a constant water level 22 by monitoring water level sensor 21. The controller 14 monitors the power consumption of the compressor 15 via power sensor 13 and looks for increases in power consumption, and if it sees an increase in power consumption of the compressor 15 the controller 14 then starts pump 19 forcing water up pipe 24 to the top part of the pipe with a plurality of holes 26 allowing water 1 to flow onto the top of the condensing-radiator 2, the water 1 runs down by gravity thought the condensing-radiator 2 uniformly wetting it, the excess water 23 returns to the reservoir 20 to be recycled. The original fan 3 forces air from the outside environment through the condensing-radiator 2 greatly enhancing the rate of water 1 evaporation thus also greatly increasing the cooling effect on the condensing-radiator 2 at a rate of removing 970 BTU (per pound of water evaporated) of heat energy from the condensing-radiator 2. The water pump 19 runs only for a few second to wet the condensing-radiator 2 and allows the water to evaporate that has wetted it, watching for any increase in power consumption via sensor 13, which increase in power will happen when the wetting water is almost finished evaporating at which time the controller 14 will again start the pump 19 for a few seconds. The pump 19 can't run for more than a few seconds without affecting the evaporation rate negatively reducing the cooling affect by as much as 20%. The effect of the water 1 evaporation is very similar to what one feels if they are swimming and when they exit the water they feel very cold, even more so if there is a wind, and that is the water evaporating and absorbing heat energy from your skin that makes one feel so cold and is what is happening here with the present invention at a rate of 970 BTU per pound of water evaporated. The water evaporating from the condensing-radiator 2 cools it and the expelled air 25 temperature being now only at ambient outside air temperature or even less, not the 50+ degrees Centigrade as described in FIG. 1 with the conventional system. The cooling of the condensing-radiator 2 by water evaporation lowers the dew point of the refrigerant inside significantly allowing it to condense at much lower pressures than with just air cooling, reducing the load on the compressor 15 thus reducing the power used and the cost to operate. The condensate 9 from the evaporating-radiator 7 is delivered to the reservoir 20 to be used for evaporative-cooling along with the makeup water 16 providing as much as 10% reduction in power consumption of the compressor 15 when used eliminating the need to dispose of the condensate 9 in a wasteful manner.

The above-mentioned, water-evaporative-cooled radiator provides a dynamically efficient way for the condensing-radiator to dispose of the latent-heat-of-condensation during the condensing process. It is helpful in reducing the electricity bill by consuming less electric power and further, reducing the load on the electrical grid. It eliminates the inefficiencies of the old process which used only air for cooling the condensing-radiator, and as the ambient temperature rises only gets more inefficient. Thus the system is also extremely environmentally friendly by reducing the great amount of load on the electrical grid in turn reduces carbon emissions created during the production of the electricity. Furthermore, the system is operating at much lower refrigerant pressure, hence the compressor becomes quieter reducing the noise pollution.

It is to be understood that the above description is intended to be illustrative, and not restrictive. The above-discussed embodiments may be used in combination with each other. Many other embodiments will be apparent to those of skill in the art upon reviewing the above description.

The benefits and advantages which may be provided by the present invention have been described above with regard to specific embodiments. These benefits and advantages, and any elements or limitations that may cause them to occur or to become more pronounced are not to be construed as critical, required, or essential features of any or all of the embodiments.

While the present invention has been described with reference to particular embodiments, it should be understood that the embodiments are illustrative and that the scope of the invention is not limited to these embodiments. Many variations, modifications, additions and improvements to the embodiments described above are possible. It is contemplated that these variations, modifications, additions and improvements fall within the scope of the invention.

I claim:

1. A system for enhancing energy efficiency of an air conditioning system, the air conditioning system comprises an evaporator radiator, an evaporator radiator fan, a compressor, a condensing radiator, a condensing radiator fan, an expansion valve, and a refrigerant, wherein the compressor is configured to compress a vaporized refrigerant to a high pressure resulting in raising a temperature above a dew point of the vaporized refrigerant before being provided to the condensing radiator for condensing to a liquid state by reducing the temperature of the vaporized refrigerant below the dew point by an air being forced by the condensing radiator fan on a surface of the condensing radiator, the system further comprises:

a power consumption sensor for measuring an electric power consumption of the compressor;

a controller, configured to regulate cooling of the vaporized refrigerant by intermittent wetting of the surface of the condensing radiator based on the electric power consumption of the compressor measured by the power consumption sensor;

a water reservoir comprising water;

a water pipe having a first end fluidly connected to the water reservoir, wherein the water pipe further comprises a plurality of holes at a second end of the water pipe; and a pump connected to the first end of the water pipe in the water reservoir, wherein the controller is in communication with the power consumption sensor to monitor the electric power consumption of the compressor and to reduce said electric power consumption by intermittently turning the pump on and off, the pump is turned on to pump the water from the water reservoir to the water pipe and to release the water through the plurality of holes which are positioned above the condensing radiator such that the released water flows via gravity onto the condensing radiator, completely wetting the surface of the condensing radiator, where additional cooling of the vaporized refrigerant inside of the condensing radiator below the dew point for condensing into the liquid state is provided by evaporating the wetting water from the surface of the condensing radiator, the evaporating being assisted by the condensing radiator fan, the additional cooling causes a reduction of the electric power consumption by the compressor due to reducing pressure requirement for the vaporized refrigerant in the compressor, while excess water returns to the water reservoir for recycling.

2. The system of claim 1, wherein the water pipe is configured to deliver the water from the first end to the second end in a vertical direction above the condensing radiator.

3. The system of claim 1, comprising a water level sensor for measuring a water level in the water reservoir.

4. The system of claim 1, further comprising a makeup water pipe, wherein the makeup water pipe is capable of delivering water to the water reservoir.

5. The system of claim 1, wherein the pump is submerged in the water in the reservoir.

6. The system of claim 4, comprising a valve in the makeup water pipe, wherein the controller monitors the water level of the water reservoir using the water level sensor and maintains a constant water level in the water reservoir by controlling water flow into the water reservoir through the makeup water pipe by opening or closing the valve in the makeup water pipe.

7. The system of claim 1, wherein the water in the water reservoir is a reverse osmosis purified water.

8. An add-on system attachable to an existing air conditioning system for enhancing energy efficiency of the air conditioning system, which air conditioning system comprises an evaporator radiator, an evaporator radiator fan, a compressor, a condensing radiator, a condensing radiator fan, an expansion valve, and a refrigerant, wherein the compressor is configured to compress a vaporized refrigerant to a high pressure resulting in raising a temperature above a dew point of the vaporized refrigerant before being provided to the condensing radiator for condensing to a liquid state by reducing the temperature of the vaporized refrigerant below the dew point by an air being forced by the condensing radiator fan on a surface of the condensing radiator, the add-on system comprising:

a power consumption sensor for measuring an electric power consumption of the compressor;

a controller, configured to regulate cooling of the vaporized refrigerant by intermittent wetting of the surface of the condensing radiator based on the electric power consumption of the compressor measured by the power consumption sensor;

a water reservoir comprising water;

a water pipe having a first end fluidly connected to the water reservoir, wherein the water pipe further comprises a plurality of holes at a second end of the water pipe; and a pump connected to the first end of the water pipe in the water reservoir, wherein the controller is in communication with the power consumption sensor to monitor the electric power consumption of the compressor and to reduce said electric power consumption by intermittently turning the pump on and off, the pump is turned on to pump the water from the water reservoir to the water pipe and to release the water through the plurality of holes which are positioned above the condensing radiator such that the released water flows via gravity onto the condensing radiator, completely wetting the surface of the condensing radiator, where additional cooling of the vaporized refrigerant inside of the condensing radiator below the dew point for condensing into the liquid state is provided by evaporating the wetting water from the surface of the condensing radiator, the evaporating being assisted by the condensing radiator fan, the additional cooling causes a reduction of the electric power consumption by the compressor due to reducing a required high pressure for the vaporized refrigerant provided by the compressor, while excess water returns to the water reservoir for recycling.

9. The add-on system of claim 8, wherein the pump is submerged in the water in the water reservoir.

10. The add-on system of claim 8, wherein the water pipe is configured to deliver the water from the first end to the second end in a vertical direction above the condensing radiator.

11. The add-on system of claim 8, comprising a water level sensor for measuring a water level in the water reservoir.

12. The add-on system of claim 8, further comprising a makeup water pipe, wherein the makeup water pipe is capable of delivering water to the water reservoir.

13. The add-on system of claim 12, comprising a valve in the makeup water pipe, wherein the controller monitors the water level of the water reservoir using the water level sensor and maintains a constant water level in the water reservoir by controlling water flow into the water reservoir through the makeup water pipe by opening or closing the valve in the makeup water pipe.

14. The add-on system of claim 8, wherein the water in the water reservoir is a reverse osmosis purified water.

15. A method for enhancing energy efficiency of an air conditioning system, which air conditioning system comprises an evaporator radiator, an evaporator radiator fan, a compressor, a condensing radiator, a condensing radiator fan, an expansion valve, and a refrigerant, wherein the compressor is configured to compress a vaporized refrigerant to a high pressure resulting in raising a temperature above a dew point of the vaporized refrigerant before being provided to the condensing radiator for condensing to a liquid state by reducing the temperature of the vaporized refrigerant below the dew point by an air being forced by the condensing radiator fan on a surface of the condensing radiator, the method comprises:

measuring electrical power consumption of the compressor using a power consumption sensor, turning on a pump depending on the electrical power consumption of the compressor by control signals from a controller configured to regulate cooling of the vaporized refrigerant by intermittent wetting of the surface of the condensing radiator based on the electric power consumption of the compressor measured by the power consumption sensor, pumping water from a water reservoir to a water pipe by the pump using the control signals from the controller, wherein the water pipe having a first end which is fluidly connected to the water reservoir, the pump being connected to the first end of the water pipe in the water reservoir, and the water pipe further comprises a plurality of holes at a second end of the water pipe, and releasing the water in the water pipe onto the condensing radiator through the plurality of holes, and uniformly wetting the radiator with the released water, while excess water returns to the water reservoir for recycling, wherein the controller is in communication with the power consumption sensor to monitor the electric power consumption of the compressor and to reduce said electric power consumption by intermittently turning the pump on and off, the pump is turned on to pump the water from the water reservoir to the water pipe and to release the water through the plurality of holes which are positioned above the condensing radiator such that the released water flows via gravity onto the condensing radiator, completely wetting the surface of the condensing radiator, where additional cooling of the vaporized refrigerant inside of the condensing radiator below the dew point for condensing into the liquid state is provided by evaporating the wetting water from the surface of the condensing radiator, the evaporating being assisted by the condensing radiator fan, the additional cooling causes a reduction of the electric power consumption by the compressor due to reducing a required high pressure for the vaporized refrigerant provided by the compressor.

16. The method of claim 15, further comprising:

keeping water level within the water reservoir at a constant level using a water level sensor and a makeup water pipe for delivering water to the water reservoir, a valve in the makeup water pipe and the controller, wherein the water level sensor is for measuring the water level within the water reservoir, and the controller is configured to control flowing of water from the makeup water pipe to the water reservoir by turning the valve in the makeup water pipe on and off depending on the water level measured by the water level sensor.

17. The method of claim 15, wherein the water in the water reservoir is a reverse osmosis purified water.

* * * * *